United States Patent [19]

Stepp

[11] 4,418,754

[45] Dec. 6, 1983

[54] METHOD AND APPARATUS FOR GRAVEL PACKING A ZONE IN A WELL

[75] Inventor: Lee W. Stepp, Comanche, Okla.

[73] Assignee: Halliburton Company, Duncan, Okla.

[21] Appl. No.: 326,681

[22] Filed: Dec. 2, 1981

[51] Int. Cl.[3] ..... E21B 43/04

[52] U.S. Cl. ..... 166/278; 166/51; 166/240

[58] Field of Search ..... 166/278, 138, 237, 51, 166/240

[56] References Cited

U.S. PATENT DOCUMENTS

| | | | |
|---|---|---|---|
| 1,803,841 | 5/1931 | Crowell | 166/138 |
| 2,365,639 | 12/1944 | Holmes et al. | 166/51 |
| 3,153,451 | 10/1964 | Chancellor et al. | 166/51 |
| 3,710,862 | 1/1973 | Young et al. | 166/278 |
| 3,726,343 | 4/1973 | Davis, Jr. | 166/278 |
| 3,913,676 | 10/1975 | Barbee, Jr. et al. | 166/278 |
| 3,926,409 | 12/1975 | Abney et al. | 251/344 |
| 3,952,804 | 4/1976 | Smyrl | 166/278 |
| 3,960,366 | 6/1976 | Abney et al. | 251/341 |
| 3,963,076 | 6/1976 | Winslow | 166/278 |
| 3,987,854 | 10/1976 | Callihan et al. | 166/278 |
| 4,044,832 | 8/1977 | Richard et al. | 166/278 |
| 4,049,055 | 9/1977 | Brown | 166/278 |
| 4,105,069 | 8/1978 | Baker | 166/51 |
| 4,273,190 | 6/1981 | Baker et al. | 166/278 |
| 4,295,524 | 10/1981 | Baker et al. | 166/278 |

*Primary Examiner*—William F. Pate, III
*Assistant Examiner*—Michael Starinsky
*Attorney, Agent, or Firm*—Alan T. McCollom; Joseph A. Walkowski; Thomas R. Weaver

[57] ABSTRACT

Apparatus adapted to be lowered on a tubing string for setting a gravel pack at the bottom of a well. Conduits provide a gravel-slurry flow path from the bottom of the tubing to a screen which is suspended from a housing at the lower end of the conduits. A packer is provided between the tubing and the housing for sealing the well bore during gravel packing. When the screen hits the bottom of the well, a clutch connected between the housing and the conduit disengages to prevent transmission of tubing movement to the screen during the gravel packing process. Upon packing completion, tubing string rotation releases the screen to permit raising of the apparatus on the tubing string.

16 Claims, 11 Drawing Figures

METHOD AND APPARATUS FOR GRAVEL PACKING A ZONE IN A WELL

BACKGROUND AND SUMMARY OF THE INVENTION

This invention relates to methods and apparatus for gravel packing a single zone in a well.

When producing fluids from one or more zones in a well, it is sometimes desirable to gravel pack the zone or zones from which fluid is being produced. Such packing is helpful in cases where the well is in an unconsolidated formation. When fluid flows through such a formation into the well bore, loose formation sand and the like may be carried with the fluid into the bore and produced to the surface of the well. This situation is harmful both to the formation, causing its collapse and preventing further fluid flow, and to the producing equipment, causing severe wear.

In order to prevent such production in unconsolidated formations, a fine gravel pack is placed in the bore at the level of the zone from which fluid is to be produced. Typically, the well bore is cased and perforated at a production zone, although open holes (uncased well bores) are packed as well. A plug is used to seal the bore beneath the zone. Immediately above the plug, a slotted screen or liner is positioned adjacent the zone and a fine gravel is packed on all sides of the screen. Fluids are then produced from the zone through the gravel pack which acts as a filter to prevent production of particulate matter from the formation to the surface of the well.

Various downhole tools provide means for lowering a screen to a selected zone and packing gravel about the screen. Such tools are typically lowered on tubing and include conduits which connect the tubing to the lower part of the tool at which point the screen is suspended. A gravel slurry is pumped down the tubing to the exterior of the screen to deposit gravel about the screen. The fluid from the slurry passes through the screen and returns to the surface of the well in the bore annulus. Many past tools are designed for packing more than one zone in a single well and may require more than one trip to the level of the zone being packed. All of the tools, whether designed for single or multiple zone packing, include various means whereby ports or valves are open and closed, typically in response to tubing manipulation by the well operator, to either treat the zone with a fluid prior to packing or to change the fluid-flow configuration in the tool subsequent to packing in order to clean the tubing and annulus with a clean fluid. Such opening and closing is often effected by shearing pins. Tools with such ports or valves are disadvantageous due to their mechanical complexity.

In contrast, the present invention overcomes all of the limitations and disadvantages of the prior art by providing a new and advantageous method and apparatus for gravel packing a zone in a well in which packing and thereafter flushing the downhole equipment is achieved without manual operation of downhole ports or valves. A further advantage of the present invention includes provision of an apparatus which permits setting a screen on the bottom of a well without the necessity of establishing a reference and without damaging the screen.

The present invention includes coaxially aligned inner and outer conduits which depend downwardly from a crossover that is adapted to be suspended from the bottom of a tubing string. The crossover permits fluid communication between the tubing string and the annulus between the inner and outer conduits as well as between the inner conduit and the annulus between the tubing and the casing. Beneath the crossover, an elastomeric packer extends about the circumference of the outer conduit. Anchor slips are provided beneath the packer to permit compression of the packer into a bore-sealing condition when the slips are anchored in the bore. A slidable screen support is positioned over the outer conduit beneath the packer. A clutch interconnects the screen support with the conduit, such being engaged so as to transmit rotary and longitudinal movement to the screen support when the support is at its lowermost position on the conduit. A screen is threadably attached to the support.

When the apparatus is lowered into a well bore and when the screen hits the bottom, the clutch between the support and outer conduit disengages and permits tubing string manipulation to effect setting of the anchor slips and compression of the packer. Thereafter, a gravel slurry is pumped down the tubing to deposit gravel about the screen. The fluid passes through the screen and returns to the surface via the inner conduit and the bore annulus. After packing, the packer seal is disengaged and a clean fluid is circulated downwardly through the bore annulus and then upwardly in the tubing to flush out gravel which might be present. The tubing is raised to engage the clutch and then rotated to unscrew the screen and thereafter raised to the surface leaving the gravel packed screen downhole.

These and other attendant advantages of the instant invention will become apparent in view of the following detailed description and the accompanying drawings.

DETAILED DESCRIPTION OF THE INVENTION

Turning now to the drawings, particularly 1*a*–1*f*, indicated generally at 10 is the preferred embodiment of the gravel packer of the invention. The preferred embodiment is shown suspended from a tubing string 12 in a casing 14 of a well drilled in formation 16. Casing 14 extends to an open hole 17 (FIGS. 4*a* and 4*b*) of the well bottom. Tubing string 12 extends from the gravel packer to the surface of the well.

Figure 1A:
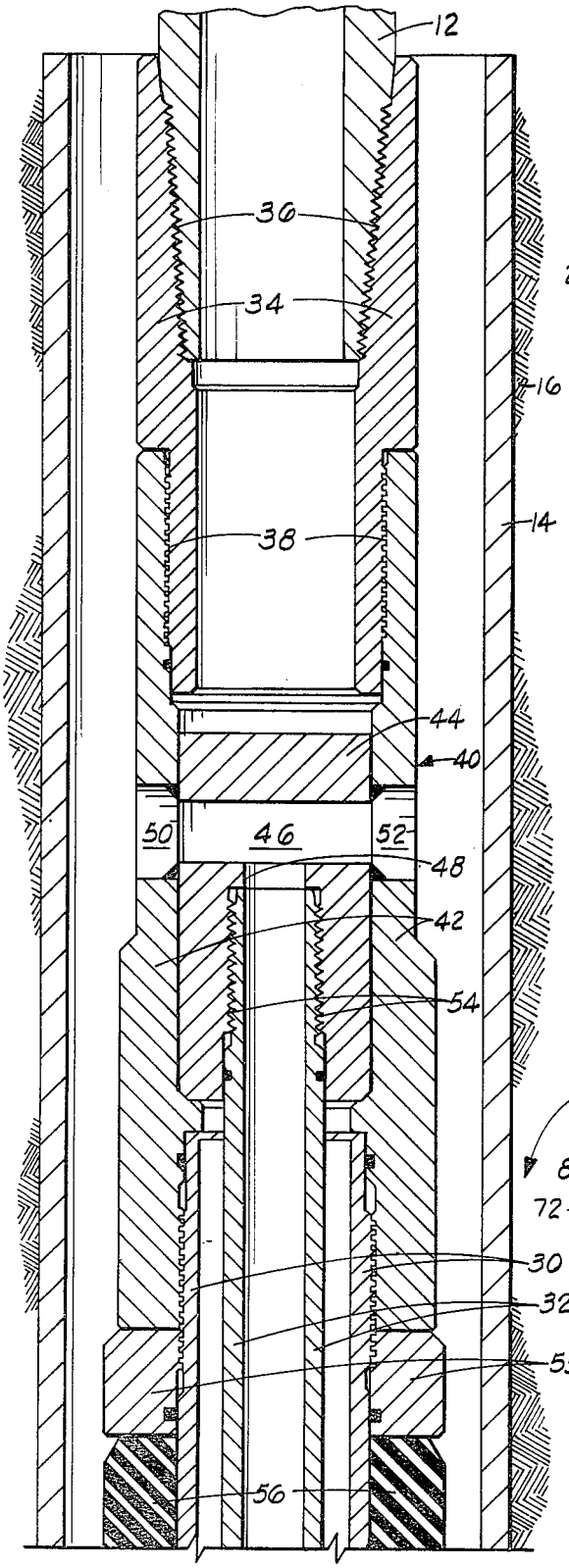
FIGS. 1*a*, 1*b*, 1*c*, 1*d*, 1*e* and 1*f*, together, constitute a longitudinal cross-sectional view of a preferred embodiment of the invention suspended in a well casing, FIGS. 1*b*–1*d* being successive downward continuations of FIG. 1*a*.
Figure 1B:
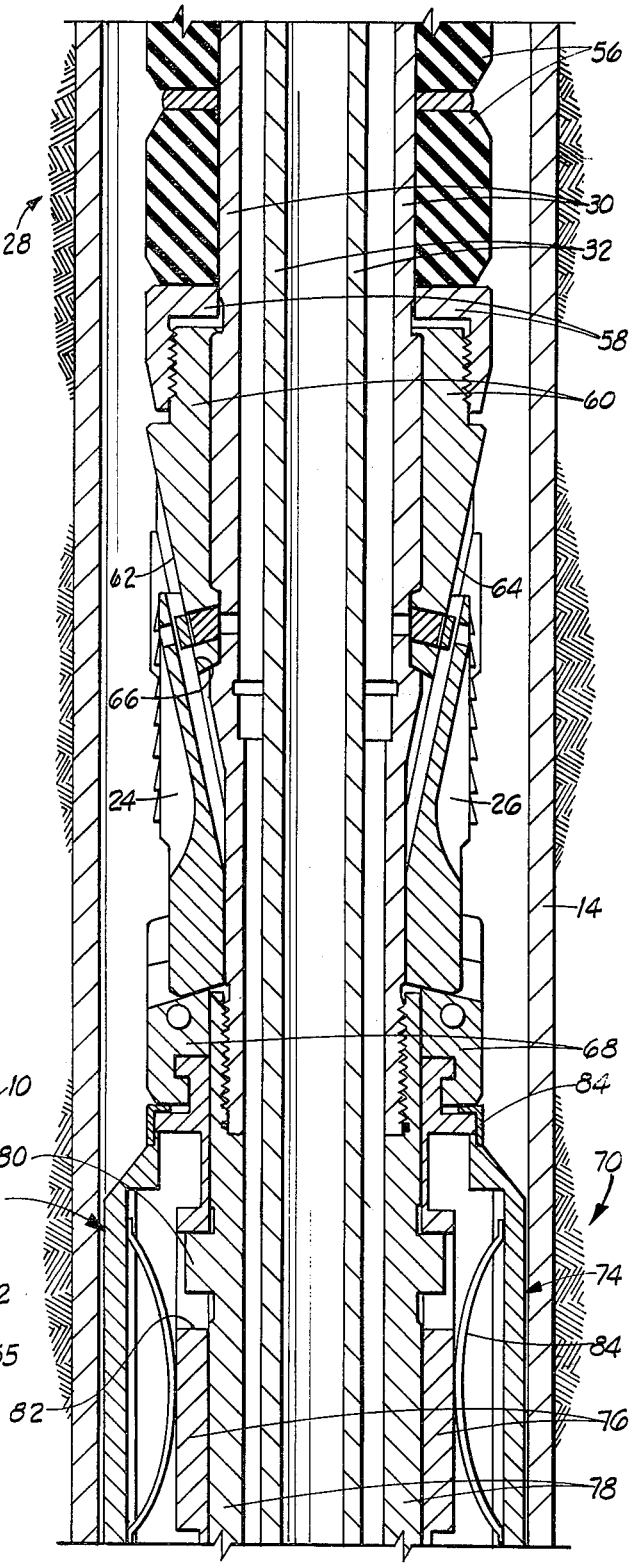

Speaking now only generally of the structure and operation of the gravel packer, a screen 22 (FIG. 1*f*) is suspended from the bottom of the packer. The packer is lowered to the bottom of the well (or to a plug in the well) at which point a gravel pack is to be created for producing fluids from the formation through the pack and up the well. At that point, anchor slips 24, 26 are engaged with the well casing to prevent further downward movement and pressure is applied via the tubing string to deform an elastomeric packer indicated generally at 28 into sealing engagement with the well casing. Thereafter, a gravel slurry is pumped down the tubing string through an outer conduit 30, and out gravel packing ports 33, 34 (FIG. 1*e*). The fluid in the slurry passes through screen 22 to its interior while depositing gravel about the outside of the screen. The fluid travels up an inner conduit 33 to the surface of the well via the annulus between the casing and the tubing. Thereafter, the anchors are disengaged from the well casing to unseal the packer and a cleaning fluid is circulated to flush away stray gravel. The tubing string is then rotated, thus unscrewing the screen from the gravel packer, and the packer is raised on the tubing leaving the screen and gravel pack in position for fluid production from the formation.

Examining in more detail the structure and cooperation of the parts of gravel packer 10, tubing 12 is attached to the gravel packer via a cylindrical adapter 34. Adapter 34 includes helical threads 36 on the interior of its upper end (to which tubing 12 is threadably attached) and threads 38 on its lower outside surface to which a crossover 40 is threadably engaged. Crossover 40 includes a cylindrical outer piece 42 and an inner piece or block 44 in the shape of a rectangular block. Block 44 includes bores 46, 48, bore 46 passing through the block horizontally and being in communication with ports 50, 52 formed in outer piece 42. Bore 48 depends downwardly in block 44 from bore 46. The block is fixedly mounted into position as shown. The block is of a size so that fluid may pass from the upper portion of outer piece 42 to the lower portion. Conduit 30 is threadably engaged with the lower portion of piece 42; thus, the upper portion of piece 42 (and hence the interior of tubing 12) is in fluid communication with the annulus between inner conduit 32 and outer conduit 30.

Inner conduit 32 is threadably engaged via threads 54 with bore 48 of block 44. Accordingly, bore 46 as well as the annulus between tubing 12 and casing 14 (via ports 52) is in fluid communication with the interior of conduit 32. As can be seen in FIG. 1*a*, various O-rings are appropriately positioned adjacent threaded connections to prevent fluid communication through the connections.

An upper shoe 55 extends about the outer circumference of conduit 30, the lower surface of shoe 55 abutting against packers 56. Packers 56 are formed of an elastomeric material and extend about the outer circumference of conduit 30. The lower surface of packers 56 abuts an upper surface of a lower shoe 58. The lower shoe likewise extends about the circumference of the outer conduit and is threadably engaged to a slip body 60.

The slip body is cylindrical in shape and includes six incline surfaces, two of which are surfaces 62, 64. All of the surfaces are formed at the same angle as surfaces 62, 64 and are all spaced at 60° intervals about the circumference of slip body 60. Six anchor slips like slips 24, 26, are distributed about the circumference of the slip body immediately therebeneath. Each of the slips includes flat surfaces like surface 66 on slip 24 which are flush against each slip's associated incline surface on slip body 60.

The six slips are engaged at their lower ends to a split ring collar 68. Collar 68 is of conventional construction and permits both pivotal and radially outward movement of the slips as will later be more fully explained.

Figure 2:
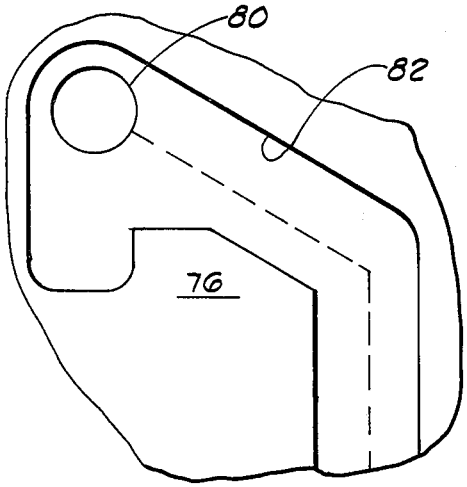
FIG. 2 is an enlarged planar elevation view illustrating the details of the drag block J-slot construction in the drag block sleeve.

Indicated generally at 70 is a drag block assembly. Included in assembly 70 are four drag blocks, like drag blocks 72, 74. The drag blocks are spaced at 90° intervals about the circumference of a drag block sleeve 76. The sleeve is substantially cylindrically shaped and is carried on a mandrel 78. Mandrel 78 is threadably engaged at its upper end to the lower end of conduit 30. The lower mandrel includes four lugs, like lug 80, each lug extending into a corresponding slot, like slot 82 in sleeve 76. FIG. 2 is a view of the slot in the sleeve as viewed from the inside of the sleeve.

Each drag block includes a surface which is biased toward casing 14 by a spring, like spring 84 in drag block assembly 70. The surface of each drag block has a relatively high frictional coefficient. Each drag block is restrained from further radially-outward travel by upper and lower retainers, like retainers 84, 86, respectively, for drag block 74. When the gravel packer is contained in conventional casing, like casing 14, each of the four drag blocks is firmly biased by the springs against the inside casing wall.

Figure 1C:
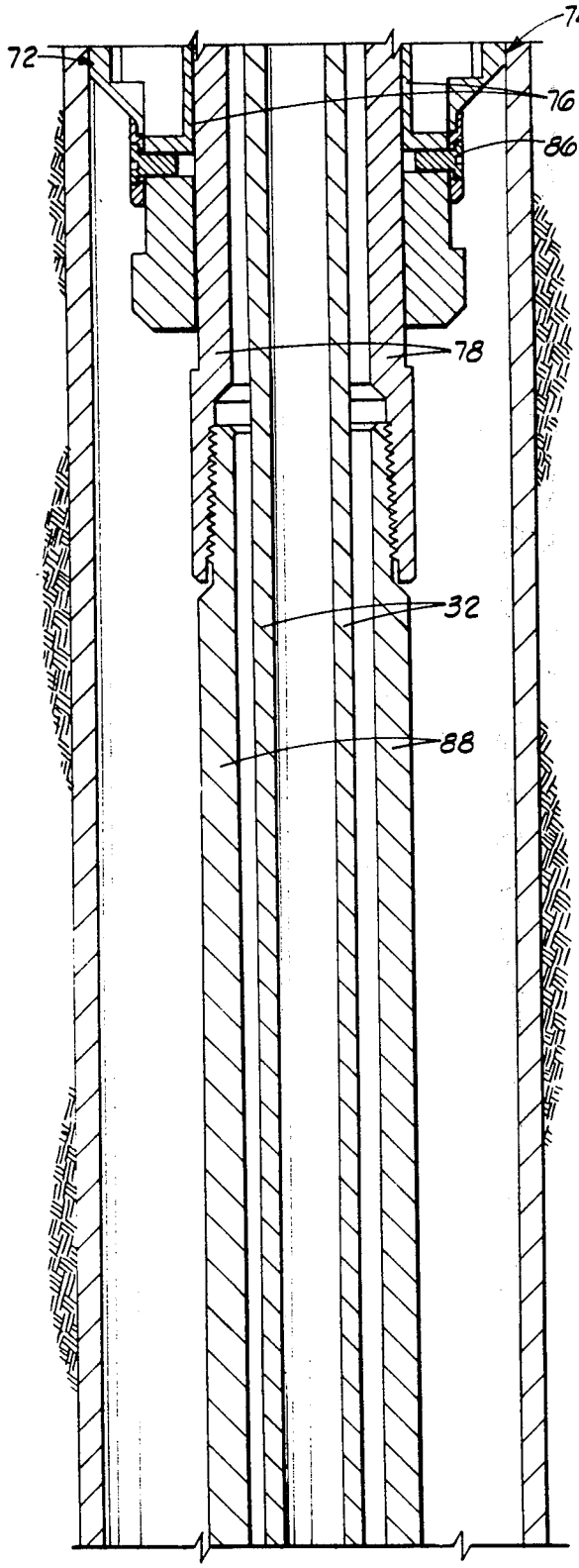
Figure 1D:
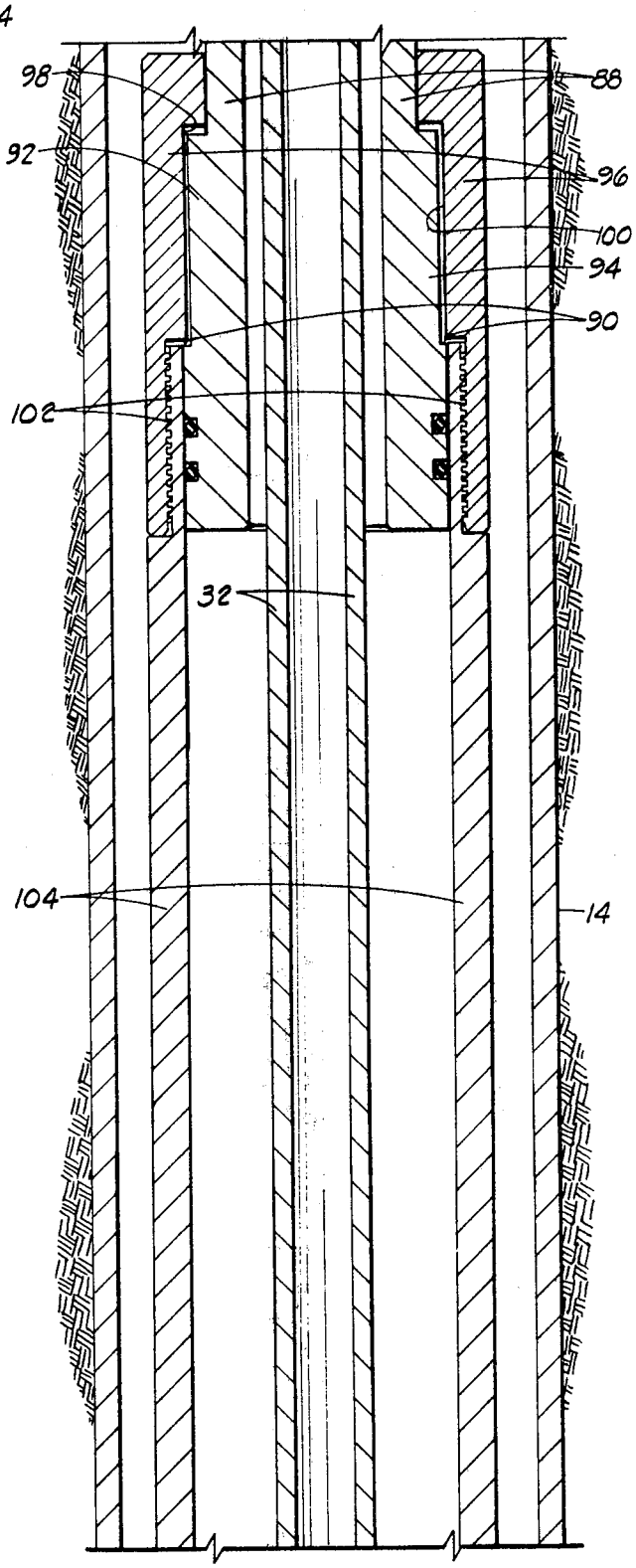
Figure 1E:
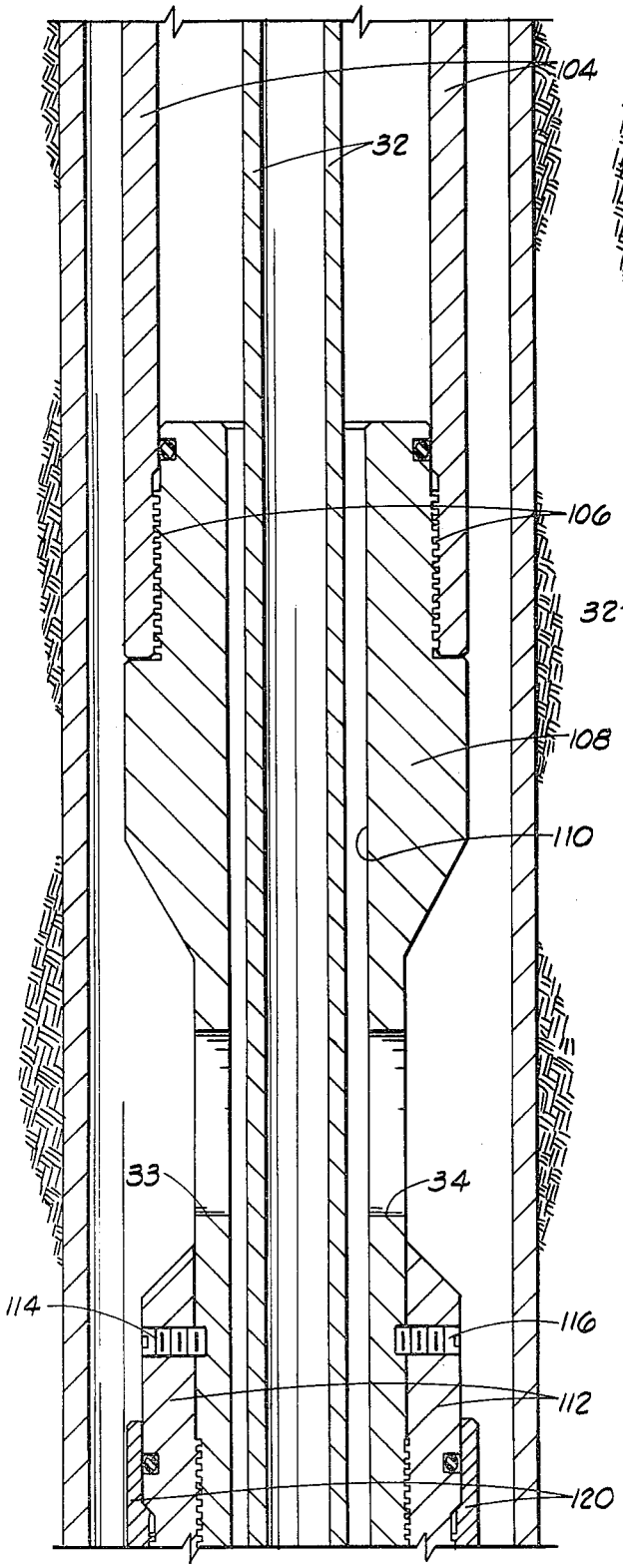
Figure 1F:
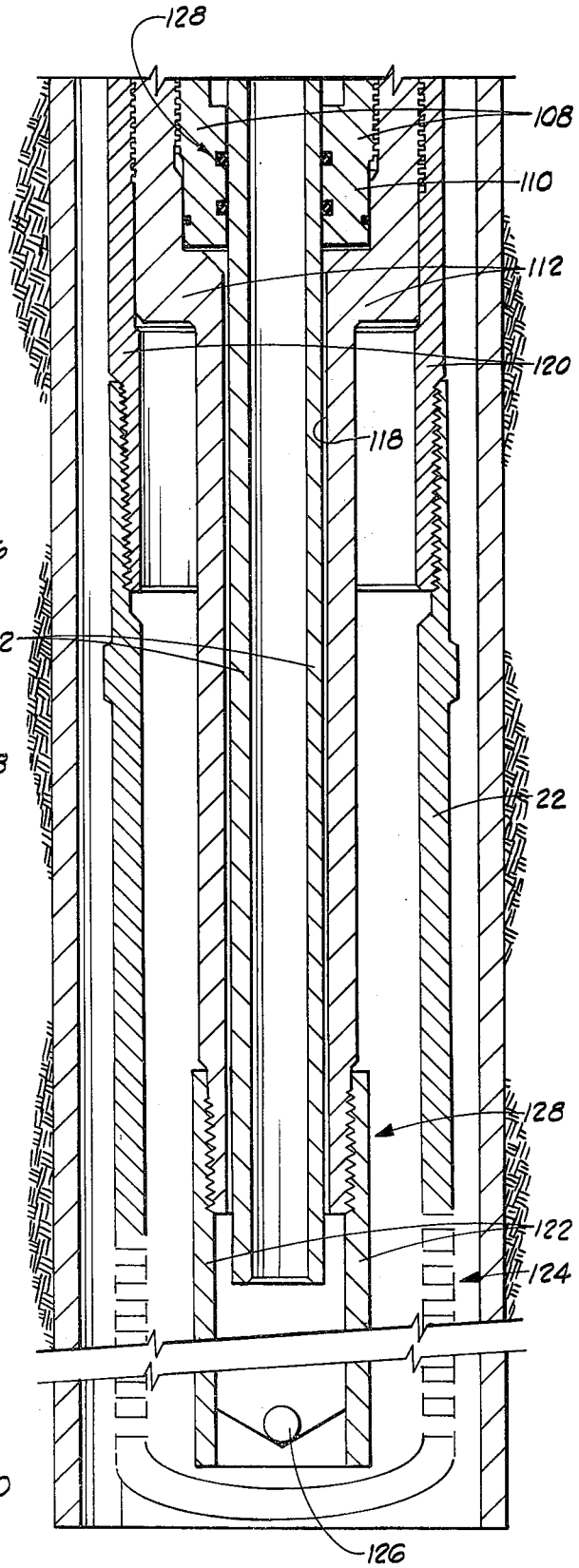

Mandrel 78, in FIG. 1*c*, includes an interior thread at its lower end which is threadably engaged with the upper end of a lower mandrel 88. The lower mandrel is a downward extension of mandrel 78 and, like mandrel 78, is in coaxial alignment about conduit 32. The lower end of mandrel 88 includes a shoulder 90 about the circumference of the mandrel. Also included are four lugs like lugs 92, 94 which extend upwardly from shoulder 90. Each lug is formed along approximately 50° of arc about the circumference of mandrel 88. The lugs are distributed at 90° intervals about the circumference of the mandrel. Each lug is tapered from its top center to its edges.

A slidable sleeve 96 is mounted over mandrel 88. The sleeve is substantially cylindrically shaped and is in coaxial alignment with mandrel 88. Slots, like slots 98, 100 are formed on the inner circumference of sleeve 96. Four slots are so formed, each being of a size sufficient to just receive one of the lugs on mandrel 88, like slot 98 receives lug 92 and slot 100 receives lug 94. When the sleeve is so fitted over the slots, it is restrained from relative rotation with respect to mandrel 88. If the sleeve is raised to the point where the lugs are not contained within the slots, the sleeve is rotatable on mandrel 88.

The lower end of sleeve 96 includes a threaded connection 102 which is connected to a lower case 104. The lower case is cylindrically shaped and at its lower end includes a threaded connection 106 (FIG. 1*e*). Connection 106 couples the lower case to a lower port body 108. The port body includes a bore 110 which extends through the vertical axis of the body along its length. Contained within bore 110 and passing therethrough is conduit 32. Gravel ports 33, 34 place bore 110 in fluid communication with the annulus between the casing and the tool.

A tubing adapter 112 is threadably secured to the lower end of port body 108 and is fixed thereto with set screws 114, 116. Tubing adapter 112 includes a bore 118 which is centered therein and extends through the adapter along its length. Conduit 32 passes through bore 118. A back-off sub 120 includes threaded connections at its upper end which are in threaded engagement with threads on adapter 112 and at its lower end which are threadably engaged to threads on the upper end of screen 22. A cylindrical wash pipe 122 is threadably mounted on the lower end of the tubing adapter.

A conventional one-way check valve 126 is mounted in washpipe 122 as shown. Valve 126 permits fluid flow in the washpipe and conduit only in an upward direction. O-rings indicated generally at 128 are in sealing engagement between conduit 32 and port body 108.

Screen 22 includes a plurality of fine holes indicated generally at 124 on its side about the circumference thereof. As will later become more fully apparent, holes 124 are of a size small enough to prevent gravel used to pack the screen from passing therethrough but are of a size large enough to permit fluids produced from the formation to pass through the gravel and into the screen.

Operation

When it is desired to pack a single zone in a well, the gravel packer is suspended from tubing string 12 and is lowered to the zone to be packed. During the lowering process, the tool is in the condition shown in FIGS. 1*a*–1*f*. The slips, like slips 24, 26 are all in their radially innermost position. As the tool is lowered, drag blocks 72, 74 slide against casing 14 and lug 80 is generally in the position illustrated in FIG. 2. Lug 80 may reciprocate between the position shown in FIG. 2 and a position directly beneath the position of FIG. 2; however, lug 80 will not travel along the dashed line in FIG. 2 since, as will be later more fully explained, rotational movement of the tubing string is required for lug 80 to so travel.

The slots within sleeve 96 (FIG. 1*d*), like slots 98, 100, have received in them their associated lugs on mandrel 88. During the lowering process all of the structure attached to the sleeve is hanging from the sleeve which is prevented from further downward movement by shoulder 90 on mandrel 88.

Figure 4A:
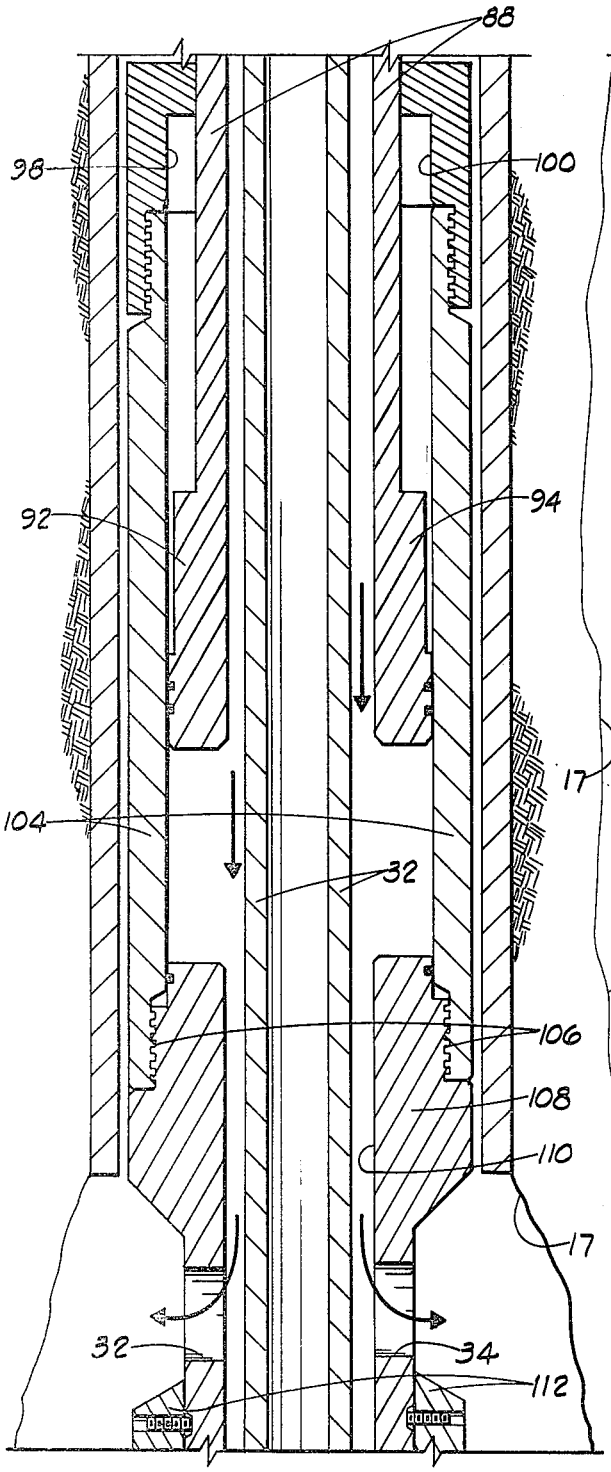
FIGS. 4*a* and 4*b* are a view of the lower portion of the instant embodiment of the invention in an open hole at the bottom of a well casing, FIG. 4*b* being a successive downward continuation of FIG. 4*a*.
Figure 4B:
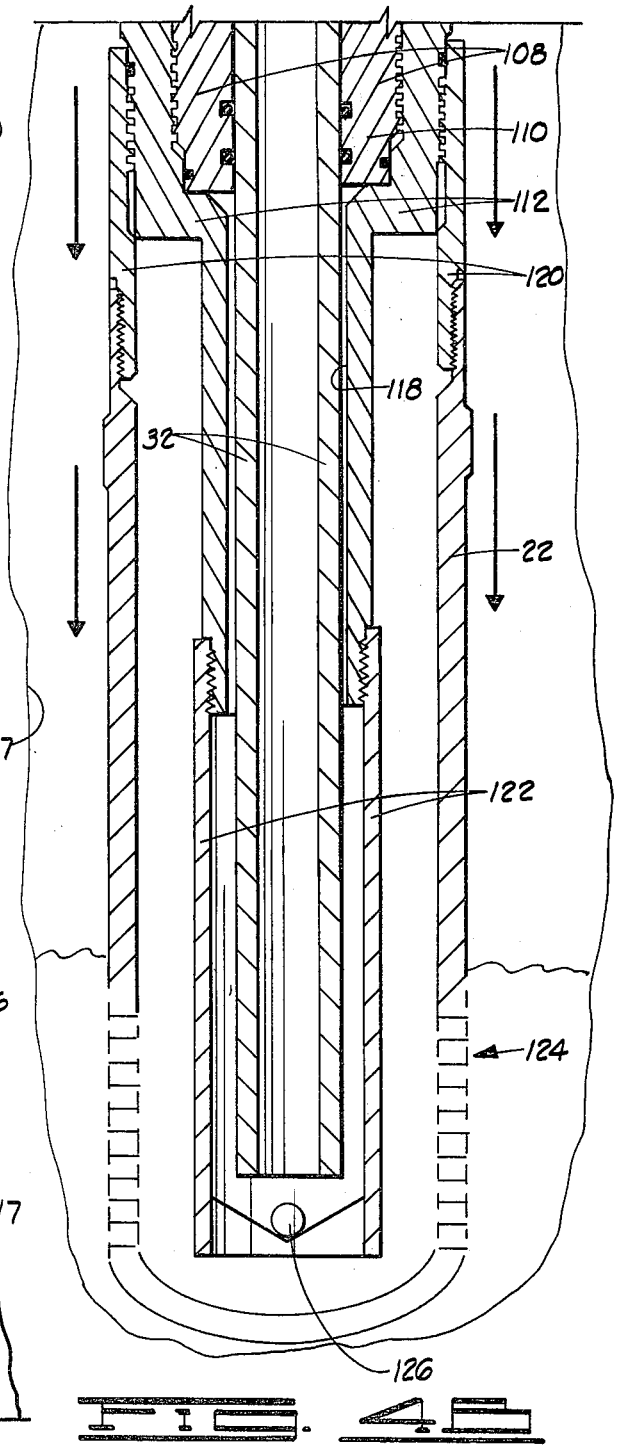

When screen 22 reaches the bottom of the well, the lower end of the screen strikes the bottom of hole 17 as shown in FIG. 4*b*. The tubing is able to continue further downward movement since mandrel 88 in FIG. 1*d* begins downward movement relative to sleeve 96 after the screen hits the bottom. As soon as the screen hits the bottom, the operator notices a reduction in weight of the tubing string, thus indicating to the operator that the screen is on the bottom. Thereafter, the operator lowers the tubing until mandrel 88 has moved downwardly from sleeve 96 to approximately the position illustrated in FIG. 4*a*. This insures that the lugs on the lower end of the mandrel are disengaged from the slots in sleeve 96, thus permitting rotation and a small range of longitudinal movement of the drill string without moving the sleeve or any structure which depends from the sleeve, including screen 22.

Figure 3:
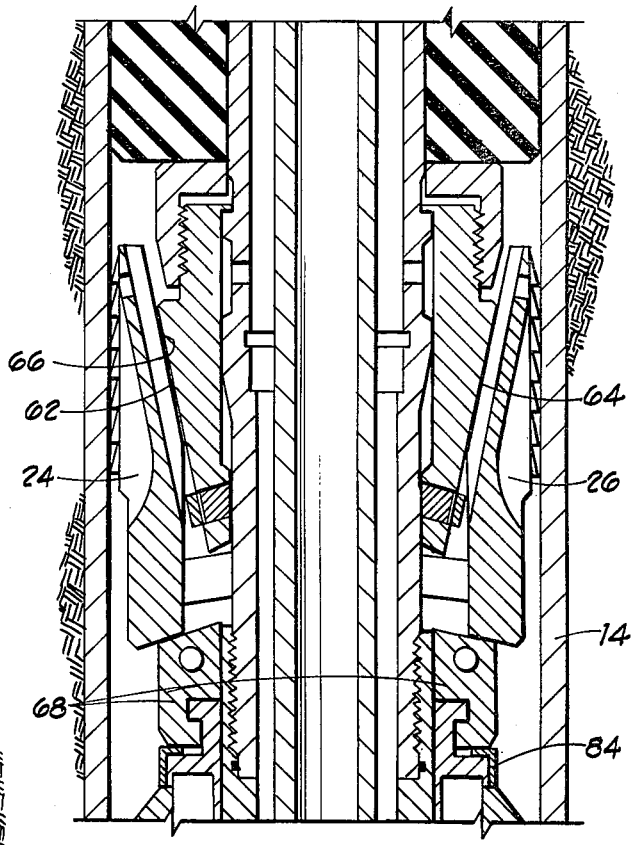
FIG. 3 is a cross-sectional view of a portion of the instant embodiment of the invention with the anchor slips engaged with the well casing and with the packer in a casing-sealing condition.

After the position of FIGS. 4*a* and 4*b* is achieved, the anchor slips, like slips 24, 26 are engaged with the casing and packers 56 are compressed to form a seal. To engage the anchor slips, the tubing string is lifted slightly, thus assuring that each of the lugs on mandrel 78, like lug 80 is at the position in its associated slot, as shown in FIG. 2. Thereafter, the tubing string is rotated to the right causing movement of the lug along the dotted line into the vertical leg on the right in FIG. 2. As soon as each lug is aligned in its associated vertical leg, the tubing is moved downwardly. Since the drag blocks are in frictional engagement with the wall's interior casing surface, the drag blocks maintain collar 68 and each of the anchor slips in a fixed position relative to downward movement of slip body 60. As the slip body moves downwardly, each of the slips is forced radially outwardly due to the action of the incline surfaces of the slip body, like surface 62, against the flat surface, like surface 66, on each of the slips. Ultimately, the slips are forced into contact with the well casing and prevent further downward movement by virtue of the grabbing action of the slips against the casing. As weight is set on the tubing string, the elastomeric packer 56 deforms into sealing engagement with the casing as shown in FIG. 3. Accordingly, fluid communication between the casing annulus above and below the packer is prevented.

After sealing the casing, the seal may be tested by injecting fluid under pressure at the surface into the annulus between tubing 12 and casing 14. Check valve 126 prevents passage of the fluid in the annulus through bores 50, 52 (FIG. 1*a*) into bore 46 and through conduit 32. Thus, if packer 56 has formed an effective seal, there is no pressure drop in the annulus when pressure is applied thereto by way of fluid injection.

After testing the seal, gravel packing of the screen may proceed. A gravel slurry is injected into tubing 12 at the surface. The slurry is a fluid which contains gravel suspended therein. The slurry descends downwardly in tubing 12 through crossover 40 into the annulus between the outer surface of conduit 32 and the inner surface of conduit 30. Mandrel 78 extends downwardly from conduit 30 and lower mandrel 88 extends downwardly from mandrel 78, each mandrel forming a continuous annulus about conduit 32 through which the slurry passes. The slurry continues through a somewhat larger annulus formed between the outer surface of conduit 32 and the inner surface of casing 104; through the annulus between the outer surface of conduit 32 and the inner surface of bore 110; and out gravel packing ports 33, 34. Such flow is indicated by arrows in FIGS. 4*a* and 4*b*.

The flow continues downwardly into hole 17 and through holes 124 in screen 22. As will be recalled, the gravel is sized slightly larger than holes 124. As the flow continues, gravel in the slurry is deposited and packed about the exterior of screen 22. The fluid from the slurry passes through holes 124 into wash pipe 122 and upwardly through valve 126 in washpipe 122. Conduit 32 communicates with bore 46 in crossover 40 (FIG. 1*a*) thus permitting the fluid from the slurry to pass through ports 50, 52 into the annulus between tubing 12 and casing 14 and from thence upwardly to the surface.

The flow of slurry down tubing 12 with the return of fluid from the slurry up the annulus continues until the operator notes an increase in pressure in tubing 12 which indicates that holes 124 in screen 22 are covered and that the screen is packed. After the operator determines, by way of measurement of pressure in tubing 12, that the screen is sufficiently packed, the flow of slurry is disconnected and packers 56 are unsealed. Packers 56 are unsealed by a simple upward movement on the tubing string. No rotation is required. As can be seen in FIG. 2, each of the lugs like lug 80, when the slips are anchored and the packer is set, are in the vertical leg to the right on slot 82. When upward movement on the tubing string occurs, lug 80 travels from the vertical leg along the dashed line against the upper surface of the slot to the position shown in FIG. 2, thus returning the drag block assemblies and slips to the position of FIG. 1*b*. When the slips are released from their engagement with the casing, packers 56 decompress and likewise return to the configuration of FIG. 1*b*. It should be noted that only a slight upward movement is required to disengage the anchors and unseal the packers. Sleeve 96 remains in substantially the same position with respect to the lugs on the lower end of mandrel 88 as that illustrated in FIG. 4*a*.

Figure 5:
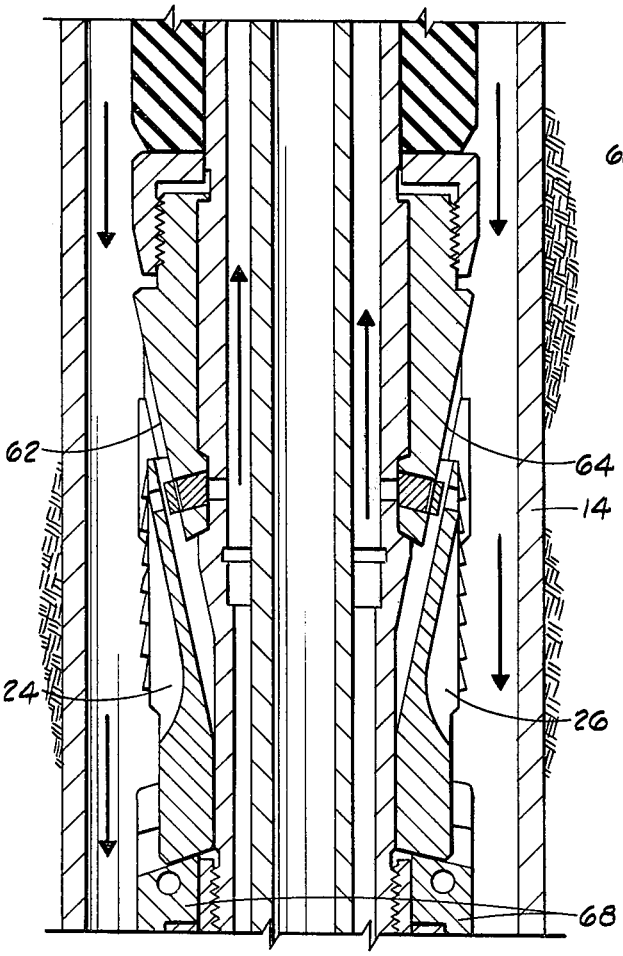
FIG. 5 is the view of FIG. 3 after packing and after disengagement of the anchor slips and unsealing the packer.

After the packers are unsealed, it is desirable to pump a clean fluid from the surface into the annulus between tubing 12 and casing 14. Check valve 126 prevents flow from the annulus into the interior of conduit 32 via ports 50, 52 in the crossover. Since the packers are unsealed, the flow of clean fluid continues downwardly beyond the packers and into hole 17 and from thence into gravel packing ports 33, 34. The screen is packed with gravel so the flow of clean fluids enters gravel packing ports 33, 34 and passes upwardly through the annulus in which the slurry traveled downwardly. This flow is illustrated by arrows in FIG. 5. The upward flow of clean fluid continues into tubing 12 to the surface. The flow of fluid washes away any stray gravel which may remain.

After such washing, tubing 12 is raised until the slots in sleeve 96, like slots 98, 100 are engaged with their associated lugs at the bottom of mandrel 88. When the lugs and slots are engaged, rotational movement of the tubing string can be translated to sleeve 96 and to all of the structure depending from the sleeve. After such slot and lug engagement, the operator rotates the tubing string to the right thus unscrewing the threaded connection between tubing adapter 112 and back-off sub 120. The tubing string is then raised thus raising the tool and leaving back-off sub 120 and screen 22 downhole in a fully packed condition.

While the invention has been particularly shown and described with reference to the foregoing preferred embodiment, it will be understood by those skilled in the art that other changes in form and detail may be made therein without departing from the spirit and scope of the invention as defined in the appended claims.

I claim:

1. An apparatus for gravel packing a zone in a well, said apparatus adapted to be lowered into a well bore on a tubing string to place a screen adjacent the zone to be packed, said apparatus comprising, screen support means for suspending said screen for placement, said screen support means including means for releasing the screen;

a gravel packing port in said screen support means, first conduit means to permit fluid communication between said tubing string and said gravel packing port;

second conduit means to permit fluid communication between said screen interior and the annulus between said tubing string and the wall of said well bore;

sealing means disposed between said gravel port and said tubing string, said sealing means being placeable in a bore-sealing condition responsive to tubing string reciprocation and rotation; and clutch means operatively connecting said screen support means and said first conduit means, said clutch means being changeable from an engaged to a disengaged condition responsive to further downward movement of said tubing string after said screen is placed adjacent said zone at the bottom of said well bore, said clutch means, when in a disengaged condition, permitting tubing string reciprocation and rotation without movement of said screen support means.

2. The apparatus of claim 1 wherein said second conduit means includes check valve means for permitting flow only in an upward direction.

3. The apparatus of claim 1 wherein said releasing means includes a threaded connection between said screen and said screen support means, said connection being releaseable responsive to right-hand tubing rotation when said clutch is engaged.

4. The apparatus of claim 1 wherein said second conduit means is coaxially aligned within said first conduit means.

5. The apparatus of claim 4 wherein said screen support means includes an elongate, substantially cylindrical housing slidably mounted over said first conduit means at the lower end thereof and wherein said clutch means includes slots positioned about the upper interior of said housing, said slots being engageable with lugs mounted on said first conduit means when said housing is at its lowermost position with respect to said first conduit means.

6. The apparatus of claim 3 wherein said sealing means are placeable in a bore-sealing condition responsive to relatively short longitudinal tubing movement and right-hand tubing rotation.

7. Apparatus adapted to be lowered on tubing into a well bore for setting a gravel pack at the bottom of the well, said apparatus comprising, a screen having an open top and perforated side, screen support means for supporting said screen, said screen support means including screen releasing means for disconnecting said screen from said screen support means;

a gravel packing port in said screen support means;

conduit means for providing a gravel slurry flow path from the tubing to said gravel packing port, through the outside of said screen to the inside, and from thence to the bore annulus;

packer means mounted around said conduit means between said gravel port and said tubing, said packer means adapted to be set into sealing engagement with the well bore responsive to longitudinal and rotational movement of said tubing; and clutch means operatively connecting said screen support means to said conduit means, said clutch means, when in an engaged condition, transmitting longitudinal and rotational tubing movement to said screen support means and, when in a disengaged condition, permitting such tubing movement without movement of said screen support means.

8. The apparatus of claim 7 wherein said clutch means is changeable from an engaged to a disengaged condition responsive to downward movement of the tubing relative to said screen support means.

9. The apparatus of claim 8 wherein said releasing means includes a threaded connection between said screen and said screen support means, said connection being releasable responsive to right-hand tubing rotation when said clutch is engaged.

10. The apparatus of claim 7 wherein said conduit means includes coaxially aligned inner and outer conduits.

11. The apparatus of claim 10 wherein said screen support means is an elongate, substantially cylindrical housing slidably mounted over said conduit means at the lower end thereof and wherein said clutch means includes slots positioned within the top of said housing, said slots being engageable with lugs mounted on said conduit means, such engagement occurring when said housing is at its lowermost position with respect to said conduit means.

12. Apparatus adapted to be lowered on tubing into a well bore for setting a gravel pack at the bottom of the well, said apparatus comprising, a crossover adapted to be mounted on the bottom of the tubing, said crossover including an external passage and an internal passage;

first conduit means extending downwardly from said crossover and in fluid communication with said internal passage to permit fluid communication between the tubing and said first conduit means;

second conduit means extending downwardly from said crossover and in fluid communication with said external passage to permit fluid communication between the bore annulus and said second conduit means;

packer means mounted about said conduit means, said packer means being setable in a bore-sealing condition responsive to longitudinal and rotational movement of said tubing;

screen support means for threadably mounting a screen thereon, said screen support means including a gravel packing port beneath said packer means, said first conduit means and said port being in fluid communication with each other; and clutch means connecting said screen support means to said first conduit means, said clutch means permitting longitudinal and rotational movement of said tubing without movement of said screen means when in a disengaged condition, said clutch means being placeable in a disengaged condition responsive to downward movement of said conduit means relative to said screen support means;

said second conduit opening beneath said screen support means to provide a return fluid path when gravel slurry is pumped down the tubing through said first conduit means and out said gravel packing port to deposit gravel about a screen suspended from said screen support means.

13. The apparatus of claim 12 wherein said second conduit means includes check valve means for permitting flow only from said second conduit means to the annulus.

14. The apparatus of claim 12 wherein said screen support means is an elongate, substantially cylindrical housing slidably mounted over said conduit means at the lower end thereof and wherein said clutch means includes slots positioned within the top of said housing said slots being engageable with lugs mounted on said conduit means, such engagement occurring when said housing is at its lowermost position with respect to said conduit means.

15. A method for gravel packing a production zone at the bottom of a well bore, comprising the steps of, providing a packer having conduit means therethrough and a screen releasably suspended from said conduit means, said conduit means providing gravel-slurry flow paths between a tubing string in the well to said screen, and further providing clutch means operatively interconnected between said screen and said conduit means, said clutch means disengaging responsive to downward tubing string movement relative to said screen to permit tubing string manipulation without movement of said screen, lowering said packer until said screen hits the well bottom thus disengaging said clutch, manipulating said tubing string to effect packer sealing of the bore, circulating gravel slurry through said conduit means to pack said screen, manipulating the tubing string to effect packer unsealing after a selected amount of gravel is packed about said screen, re-engaging said clutch by upward movement of said tubing string;

releasing said screen from said packer, said conduit means and said tubing string by rotating said tubing string, and raising the tubing string.

16. The method of claim 15 which further includes the step of reverse circulating a clean fluid in said conduit means subsequent to effecting packer unsealing to permit fluid flow in the bore from beneath the packer to the well surface in the bore annulus.

* * * * *